US005435770A

United States Patent [19]

Balentine

[11] Patent Number: 5,435,770

[45] Date of Patent: Jul. 25, 1995

[54] METHOD OF MANUFACTURING ETCHED WOOD PRODUCTS

[76] Inventor: Linda Balentine, 1929 Sheffield Rd., SW., Roanoke, Va. 24015

[21] Appl. No.: 67,692

[22] Filed: May 26, 1993

[51] Int. Cl.[6] ..... B24C 1/04

[52] U.S. Cl. ..... 451/31; 451/38; 451/442

[58] Field of Search ..... 51/319, 320, 310, 311, 51/312, 262 R; 451/38, 39, 29, 30, 31, 442

[56] References Cited

U.S. PATENT DOCUMENTS

| | | | |
|---|---|---|---|
| 2,109,000 | 2/1938 | Waldo, Jr. | 51/312 |
| 2,706,355 | 4/1955 | Brown | 51/319 |
| 3,117,403 | 1/1964 | Jack et al. | 51/311 |
| 3,267,621 | 8/1966 | Meyers et al. | 427/259 |
| 3,837,881 | 9/1974 | Hix | 117/8 |
| 4,093,754 | 6/1978 | Parsons | 430/308 |
| 4,133,919 | 1/1979 | Parsons | 51/312 |
| 4,199,358 | 4/1980 | Parsons | 430/308 |
| 4,587,186 | 5/1986 | Nakamura et al. | 51/310 |
| 4,702,786 | 10/1987 | Tallman | 51/310 |
| 5,257,655 | 11/1993 | Skendzel | 51/319 |

FOREIGN PATENT DOCUMENTS

| | | | |
|---|---|---|---|
| 0067977 | 6/1978 | Japan | 51/320 |
| 0020860 | 2/1985 | Japan | 51/319 |
| 2218657 | 11/1989 | United Kingdom | 51/310 |

*Primary Examiner*—Robert A. Rose

*Attorney, Agent, or Firm*—Whitham, Curtis, Whitham & McGinn

[57] ABSTRACT

Screening techniques are used to form a patterned mask on a surface of a wood article, and particle blasting is used to transfer the pattern of the mask to the wood article. A screen on procedure that employs a 50–80 mesh material on which a reverse image pattern of 200 microns or thicker of capillary film allows a high definition pattern of masking material to be applied in one pass. Disruption of the mask from moisture emanating from the wood article is prevented by either painting the surface of the wood article prior to screening on the masking material or by including a water scavenging compound with the masking material. If paint is to be employed as a moisture barrier, the paint must be able to withstand curing temperatures for the masking material. Spherical glass beads are preferably used for particle blasting since they leave a better finish for the pattern transferred to the wood article and do not adversely degrade the wood fibers. Woods, such as Western Red Cedar, Ponderosa Pine, Fir, and Redwood, can be easily patterned by the particle blasting and provide enhanced wood grain definition.

4 Claims, 4 Drawing Sheets

METHOD OF MANUFACTURING ETCHED WOOD PRODUCTS

BACKGROUND OF THE INVENTION

1. Field of the Invention

The invention generally relates to manufacturing decorative wood articles that have etched patterns formed therein by a masking/particle blasting process.

2. Description of the Prior Art

In the past, wood articles have been patterned by adhering sand-blast resistant masks to the surface of a wood article, followed by sand-blasting the masked wood surface to etch the unmasked portions. The masks are subsequently removed to reveal the contrast between the patterned flat relief and the etched wood grain. The prior art techniques for applying the mask to the wood surface are labor intensive, leading to high costs and low production output. Specifically, a strip of rubber, thermoplastic, or other sand-blast resistant material is die stamped or patterned by some other cutting machine. The patterned strip is secured to the wood surface using an adhesive. Portions of the strip are then removed by hand to produce the mask on the surface of the wood article. Strips which have been patterned (stamped) with very intricate designs require considerably longer periods of time for producing the mask which will ultimately be used to pattern the wood since each small sacrificial piece of the strip must be removed by hand. In addition to being labor-intensive, the prior art technique for creating the pattern on the wood surface leads to etching problems during sand-blasting. In particular, if part of the mask is pulled up while removing sacrificial portions of the die stamped strip, the blasting material will be able to etch the wood underneath the portion of the mask that is not adhered tightly to the wood surface.

U.S. Pat. No. 4,702,786 to Tallman discloses variation on the wood sign sandblasting technique described above. Specifically, a flexible sheet material laminate having a "sign" material component and a "mask" material component is patterned using a laminate cutting machine. Sacrificial portions of the laminate are discarded to form a mask that is positioned on the surface of a wood article. The pattern is then transferred to the wood article by sandblasting, whereby the "mask" material component of the laminate protects underlying portions (e.g., both underlying "sign" material and underlying wood) while unmasked portions of the wood are cut and patterned by exposure to the stream of sand particles. After sandblasting, the "mask" material component of the laminate is removed to expose the "sign" material layer of the laminate. The "sign" material, which could be a corporate logo, design, lettering, etc., then becomes a permanent part of the patterned wood article.

A number of prior patents disclose procedures for forming decorative patterns on glass, plastic and metal. For example, U.S. Pat. No. 3,267,621 to Meyers et al., U.S. Pat. No. 3,837,881 to Hix, U.S. Pat. No. 4,093,754 to Parsons, U.S. Pat. No. 4,133,919 to Parsons, and U.S. Pat. No. 4,199,358 to Parsons all disclose using silk-screen procedures to form a pattern of a masking material on a glass, plastic, or metal substrate, curing the masking material to render a sandblast resistant mask, and transferring the pattern to the glass, plastic or metal substrate via sandblasting.

SUMMARY OF THE INVENTION

It is an object of this invention to provide a quicker, less labor-intensive, and less expensive process for manufacturing decorative wood articles that uses particle blasting to create a pattern in the wood article.

It is another object of this invention to provide one-pass screen-on process for creating a masking pattern on a wood article.

According to the invention, patterns are created in wood articles by a less expensive and less labor intensive process which utilizes a screening technique for application of a masking material to the wood followed by particle blasting of unmasked portions under blasting conditions and with a particular blasting media suitable for etching wood articles. The masking material is advantageously applied by a one pass screen-on process wherein the masking material is applied to the wood surface through a 60–76 mesh polyester screen on which the reverse pattern image has been created using an emulsion having a thickness of 200 microns or more. An off-screen technique is used to apply the masking material on the wood surface to a thickness of approximately ⅛ inch. The combination of a mesh screen and a thick emulsion achieved with capillary film allows high definition patterns of masking material to be applied to the wood surface. Because wood is a "living", organic substrate, unlike glass, plastic, and metal, water released from the plant cells during curing of the masking material must be prevented from disrupting the mask. For bare wood articles, including a water scavenger with the masking material or applying the water scavenger prior to application of the masking material prevents water from "blistering" or "bubbling" through the masking material. Painting the wood article prior to applying the masking material can provide a moisture barrier which can be used to prevent water disruption of the masking material; however, the paint selected must be able to withstand the cure temperatures used for curing the masking material. In addition, judicious selection of the wood substrate can aid in preventing disruption of the masking material during particle blasting.

BRIEF DESCRIPTION OF THE DRAWINGS

The foregoing and other objects, aspects and advantages will be better understood from the following detailed description of the preferred embodiments of the invention with reference to the drawings, in which.

DETAILED DESCRIPTION OF THE PREFERRED EMBODIMENTS OF THE INVENTION

Wood is a "living", organic material with a unique grain structure in every piece. The texture and grain of wood are the source of its beauty and make it an ideal material for plaques, signs, picture, frames, molding, etc. where the wood grain is used as a decorative feature.

Silk screening is a well recognized procedure for applying paint and other materials to a surface. For example, designs on T-shirts, golf towels and other cloth items are commonly created by silk screen procedures. U.S. Pat. No. 3,627,621 to Meyers et al., U.S. Pat. No. 3,837,881 to Hix, and U.S. Pat. No. 4,199,358 to Parsons show the use of silk screening techniques to apply resist patterns to a glass, metal, or plastic surfaces which will subsequently be abraded via sandblasting.

Figure 1A:
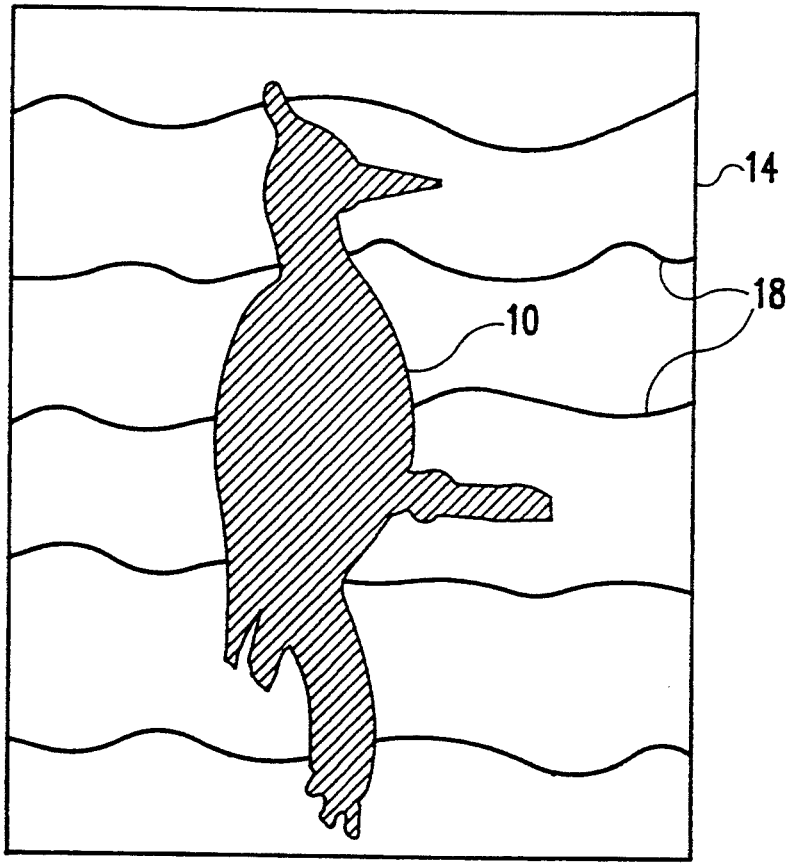
FIGS. 1*a* and 1*b* are top and side views, respectively, of a screened-on masking material forming a pattern on a piece of wood.
Figure 1B:
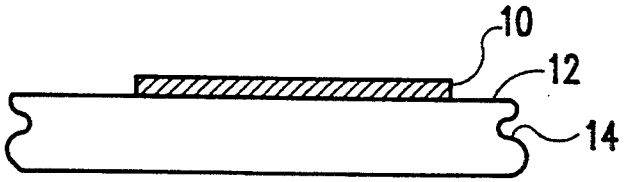
Figure 2A:
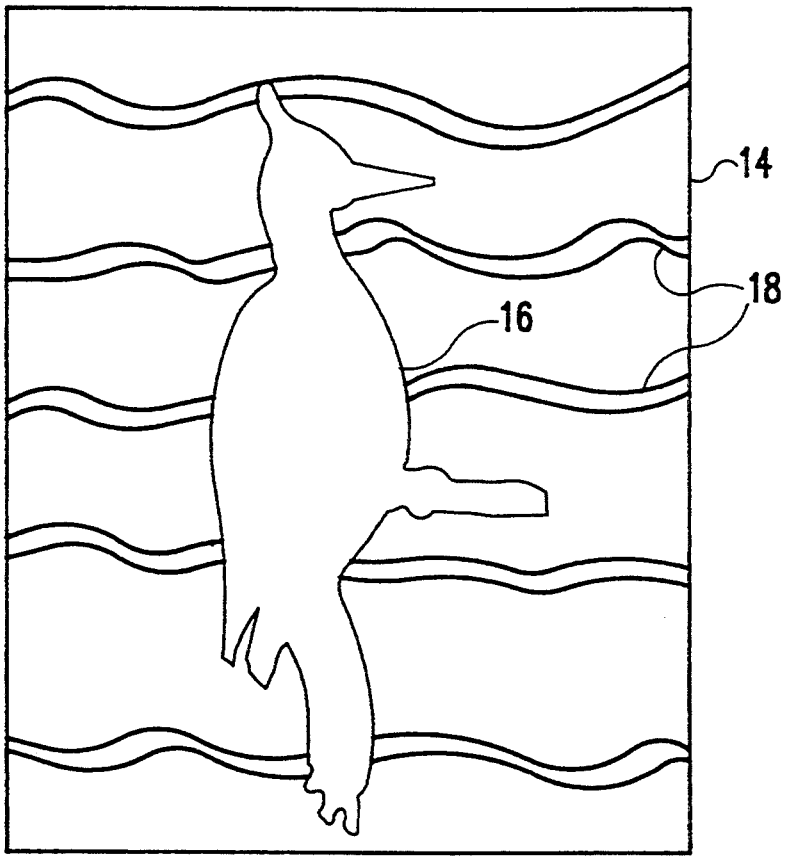
FIGS. 2*a* and 2*b* are top and side views, respectively, of the piece of wood of FIGS. 1*a* and 1*b* after particle blasting and removal of the mask.
Figure 2B:
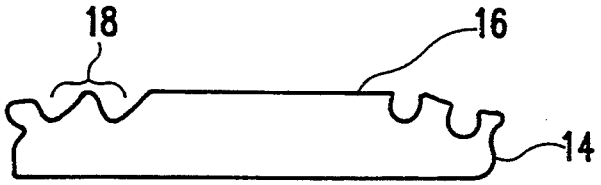

This invention employs silk screening procedures to apply a masking material to the surface of a wood article which is to be patterned. FIGS. 1*a* and 1*b* show a pattern 10 applied to the surface 12 of a wood article 14. Silk screening has a distinct advantage over prior art wood etching techniques in that the pattern 10 can be extremely complex, with curved areas, tight corners, and the like, yet the pattern 10 is easily formed in an automated fashion using silk screening equipment. As discussed above, prior art wood etching techniques have required applying a stamped strip to the wood surface, followed by laboriously removing each of the areas required to create the pattern of interest.

With reference to FIGS. 1*a* and 1*b*, a pattern 10 of masking material is applied to a wood surface 12 using a silk screen or similar procedure. The masking material can be a plastisol, epoxy, rubber, or asphaltic composition. Plastisols are preferred and are typically composed of a finely divided thermoplastic resin dispersed in a plasticizer. Many plastisols include polyvinyl chloride as a principle component. Thermosetting resins may also be employed as masking materials. The chief requirement of the masking material is that it must adhere to the wood surface and the cured mask formed from the masking material must be able to withstand particle blasting procedures used to transfer the pattern into the wood article. Ideally, the pattern 10 can be applied in one pass and should also be easily removed from the wood surface 12 by peeling.

Figure 4:
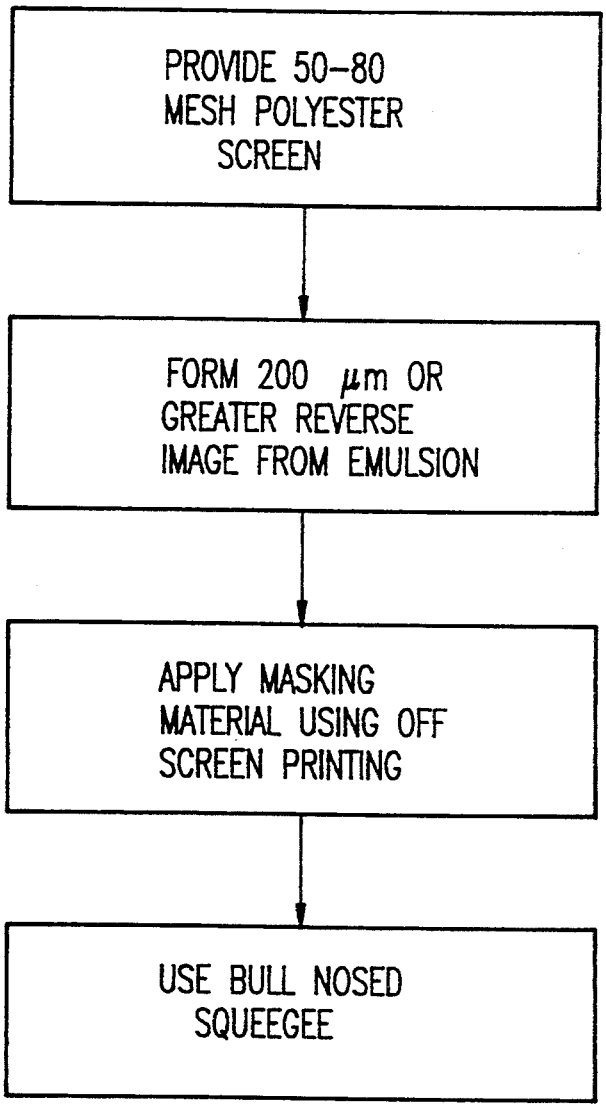
FIG. 4 is a schematic diagram of process steps used to apply a masking material pattern in a one pass screen on procedure.

One important aspect of this invention is the development of a one pass screen-on procedure for applying the pattern 10 of masking material to the wood surface. As shown in FIG. 4, the screen employed should have a mesh size between 50–80 squares per inch, and particularly good results have been achieved with 60–76 polyester mesh material. With a more open mesh (e.g., less than 50 mesh), the definition of the pattern becomes distorted and very high definition patterns, such as the woodpecker in FIG. 1*a*, cannot be created. Conversely, with a tighter mesh (e.g., greater than 80 mesh), the viscous masking material cannot easily pass through the small openings and be deposited on the wood surface.

A thick emulsion of 200 microns or greater must be used to create a reverse image pattern on the mesh material used to screen on the masking material. This can be achieved by building up layers of traditional emulsion, piggybacking capillary emulsions, or by other suitable means. As is common practice in silk screen procedures, the reverse image pattern can be created by ultraviolet exposure of the emulsion to cure/harden the emulsion in the exposed areas, followed by washing away the unexposed (and uncured) portions of the emulsion. Other techniques for creating the thick reverse image pattern on the mesh material can be employed, and can vary depending on the choice of emulsion and exposure tool (e.g., IR, laser, etc.). The important feature is that a reverse image pattern that is at least 200 microns thick is created. It has been discovered that with reverse image patterns that are less than 200 microns in thickness, an insufficient amount of masking material is applied to the wood surface to create the pattern in one pass.

An off-screen technique is used to apply the masking material to the wood surface. Off-screen printing involves elevating the meshwork above the wood surface. A bull-nosed or rounded squeegee should be used to push or pull the masking material over the meshwork. Squared off and tapered squeegees were found to be unsuitable as using these types of squeegees resulted in not enough masking material being deposited on the wood surface.

Common to all masking materials is the need to cure the masking material, which is in a gelatinous or liquid phase when applied, into a hardened mask which will withstand impacting abrasive agents. Curing is accomplished by heating the masking material after application to the wood surface 12. Curing drives off solvents and reaction products, fuses the chemical constituents, and causes the mask to tightly adhere to the wood surface. Elevated temperatures on the order of 200° C. or more are used to cure the masking material. The cure temperature and time are highly variable and depend on the chemical constitution of the masking material. Some plastisols require cure temperatures in excess of 300° C.

It has been discovered through experimentation that decorative patterns cannot be created in wood articles simply by screening on a resist masking material and subsequently abrading the exposed portions of wood by sandblasting. Unlike glass, plastic, and metal substrates, wood is composed of cellular matter. During curing of the masking material, the cells release moisture. This moisture degrades the masking material's ability to adhere to the wood surface and also "blisters" or "bubbles" through the masking material itself. A loosely adhering mask or mask that has been weakened in spots by the "blistering" or "bubbling" action of moisture released from cells is ineffective for pattern transferring operations because the abrasive material directed toward the mask will permeate the mask and scar the underlying wood surface.

Therefore, another important aspect of this invention is to provide a wood patterning procedure that overcomes moisture release problems, thereby allowing the use of silk screening to apply the masking material.

One method of protecting the integrity of the pattern from moisture problems that arise during curing is to provide a water scavenging agent at the pattern 10/surface 12 interface. Suitable water scavenging agents include anhydrous calcium sulfate (e.g., Drierite®), silica-gel products (e.g., Drimix®), sodium phosphate tribasic ($Na_3PO_4$; Dri-Tri®), and the like. The water scavenging agent can be applied to the surface 12 of the wood 14, via spraying, dipping, or any other suitable technique, prior to screening on the masking material. Alternatively, the water scavenging agent can be combined with the masking material such that the two are simultaneously applied during the screening procedure. This technique is especially useful when the pattern is to be applied onto bare wood 14 as is shown in FIGS. 1*a* and 1*b*, since the water scavenging agent will be present at the interface of the pattern 10 and surface 12 and will absorb the water moisture as it is produced.

Figure 3:
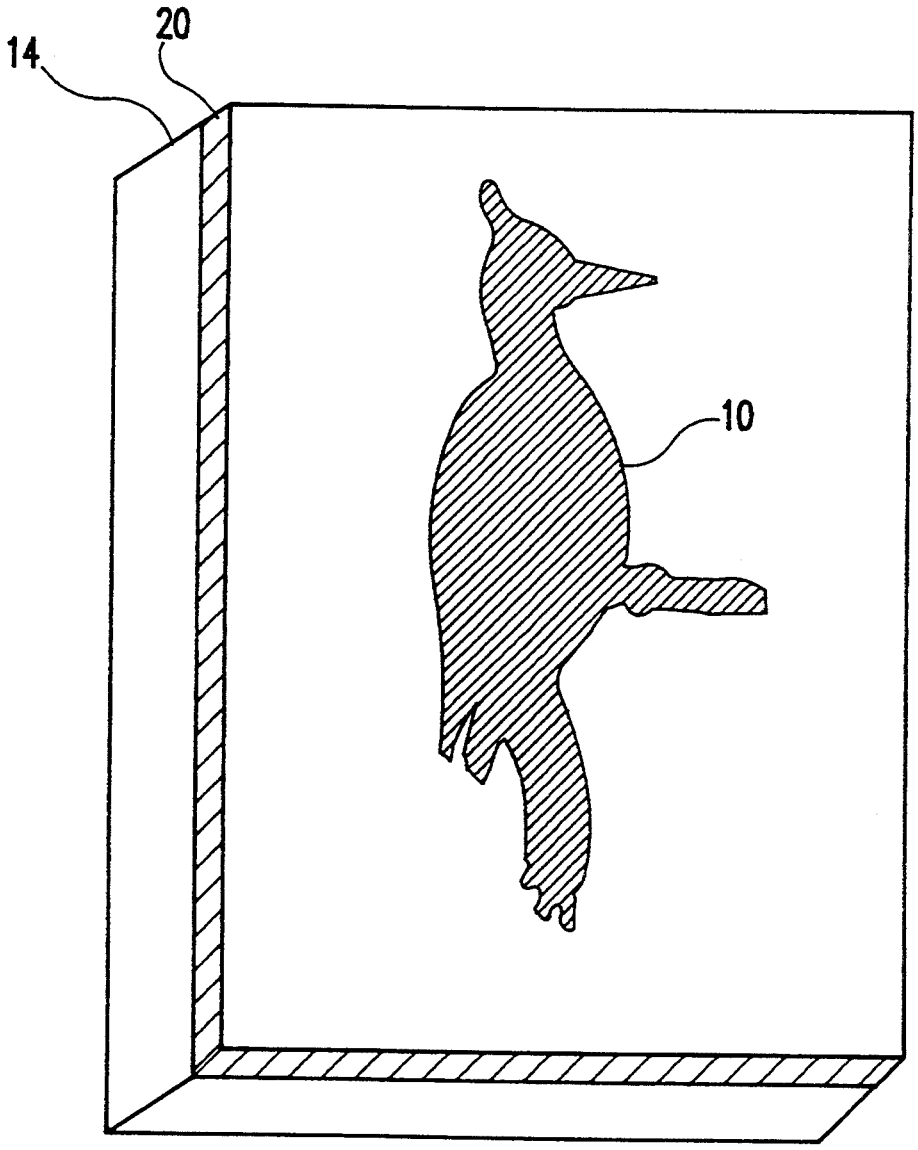
FIG. 3 is an isometric view of a wood article having a painted surface with screened-on masking material forming a pattern on a piece of wood.

FIG. 3 shows an alternative method for protecting the integrity of the pattern from moisture problems that arise during curing wherein the wood 14 is painted with a coat of paint 20 prior to screening on the pattern 10 of masking material. Paint 20 provides an effective moisture barrier, but is easily removed by particle blasting in areas unprotected by a mask. Selection of a suitable paint 20 is an important step if this method is to be employed. The paint 20 must withstand the cure temperature for the masking material which can sometimes be greater than 300° C. and the masking material must adhere to the paint 20 after curing. It has been found that urethanes, enamels, and lacquers work best as the paint 20. By contrast, acrylic paints and other water soluble paints break down at elevated temperatures and release moisture, thereby adding to the moisture problem inherent in a wood substrate.

The adverse effects of moisture on the masking material can also be minimized by judicious selection of the wood substrate. All wood substrates should be kiln dried or otherwise treated to remove extraneous moisture.

FIGS. *2a* and *2b* show that the shape of pattern 10 is transferred into the wood 14 at region 16 by blasting the wood surface with particles after curing the mask. Ideally, the wood 14 is etched more deeply along the grain 18 so that the unique grain structure of each piece of wood is enhanced for decorative purposes. Unlike glass, plastic, and metal substrates which are patterned by abrading techniques where only a slight shading or level variation in the substrate is required for decorative purposes, the particle blasting needed for wood articles is more intense. It has been found that particle pressures of greater than 60 pounds per square inch (psi), and preferably, pressures of 60–100 psi, are best suited for etching unmasked portions on a wood surface. Typically, the trenches created, which are best shown along the grain 18 in FIG. *2b*, are on the order of a quarter of an inch deep; however, the intensity of the particle stream, the distance and angular orientation of the blasting nozzle relative to the wood substrate, and the length of the particle blasting times can be adjusted to achieve penetration to any desired depth.

With particular reference to FIGS. *2a* and *2b*, it can be seen that the objective of the patterning process is to provide a particle blasting procedure which does not scar the region 16 and provides a smooth finish that does not degrade the fibers in the patterned grain regions 18. Hence, the particle blasting must be intense enough to etch exposed wood, but not so intense as to etch through the mask 10. Although many different woods can be decoratively etched using the inventive procedure, Western Red Cedar, Fir, Ponderosa Pine, and Redwood have been found to be excellent substrates for the inventive procedure because of the ease of particle blasting these woods and the intense grain definition achieved.

It has been found that the choice of particle blasting media plays an important role in achieving optimum results. Specifically, experiments demonstrate that near spherical glass beads (80% round), and especially G8 glass beads (60–100 mesh), are the best particle blasting media. These glass beads meet military specifications for roundness. G8 glass beads leave a smooth surface on the etched wood and do not degrade the fiber integrity. In addition, the near spherical (80% round) G8 glass beads do not breakdown the mask material while the exposed wood is being etched. By contrast, aluminum oxide, crushed glass, and sand tend to tear up the mask so that the patterned region becomes marred. Moreover, aluminum oxide, crushed glass, and sand leave a rough finish in the etched areas and tend to disrupt fiber integrity.

From the experimental results, it is believed that the surface characteristics of the blasting media play an important role in the finished product. The glass beads used are near spherical (80% round), while aluminum oxide, crushed glass, and sand have sharper edges. The roughened finish of wood etched with aluminum oxide, crushed glass or sand may be the result of the sharp edges breaking wood fibers in an uneven manner. By contrast, the smooth finish of wood etched with spherical glass beads may be a result of the smooth surfaces of the beads cutting the wood fibers evenly during particle blasting.

In addition to the choice of the blasting media, it has been found that the distance between the nozzle and the wood substrate as well as the orientation of the nozzle relative to the wood substrate have a significant impact on the ability to neatly etch the wood. Specifically, the blasting nozzle should be located between eight and twelve inches from the wood surface. Positioning the nozzle closer tends to cause degradation of the mask as well as disruption of the wood fibers in the exposed regions. However, positioning the nozzle farther away from the wood slows down the etching process and could limit the depth of cut. With respect to the orientation of the blasting nozzle, it has been found that the nozzle should be angularly oriented between 30° and 60° relative to the wood surface. Best results have been achieved when the nozzle is oriented at 45° relative to the wood surface. The angular orientation of the nozzle allows the blasted particles to carve the wood out in the exposed areas. If the nozzle is oriented perpendicular to the wood surface, the particles tend to embed in the wood leaving an unsightly finish. In addition, "straight ahead" blasting tends to disrupt the wood fibers. Therefore, smoother cutting in the wood grain is best achieved by angling the nozzle relative to the wood surface during the particle blasting procedure.

The mask 10 is ideally removed from the wood 14 by peeling after the particle blasting. High impact water washing, which can be employed with metal, glass, and plastic, would not be suitable for wood because the water will cause warping of the wood and will tend to disrupt the delicate wood grain produced by the etching procedure. The masking material should be selected such that peeling of the cured mask proceeds easily without pulling up any underlying wood fibers.

While the invention has been described in terms of its preferred embodiments, those skilled in the art will recognize that the invention can be practiced with modification within the spirit and scope of the appended claims.

I claim:

1. A method of manufacturing patterned wood articles, comprising the steps of:

screening a masking material onto a surface of a wood article in a specified pattern which leaves portions of said surface uncovered by said masking material;

curing said masking material to create a mask on said surface of said wood article; 'particle blasting said surface of said wood article to etch wood on said surface at said portions of said surface uncovered by said masking material, said particle blasting being performed at a pressure which will not degrade said mask;

providing a water scavenger on said wood surface whereby moisture emanating from said wood article is prevented from disrupting said mask; and removing said mask from said surface of said wood article.

2. The method of claim 1 wherein said step of providing said water scavenging compound or material is performed prior to said step of screening said masking material on said wood surface.

3. The method of claim 1 wherein said step of providing said water scavenger is performed simultaneously with said step of screening said masking material on said wood surface by combining said water scavenger with said masking material prior to said step of screening said masking material on said wood surface.

4. A method of manufacturing patterned wood articles, comprising the steps of:

screening a plastisol masking material onto a surface of a wood article in a specified pattern which leaves portions of said surface uncovered by said plastisol masking material;

curing said plastisol masking material to create a mask on said surface of said wood article;

particle blasting said surface of said wood article with spherical glass beads to etch wood on said wood surface at said portions of said surface uncovered by said masking material;

providing a water scavenger on said wood surface whereby moisture emanating from said wood article is prevented from disrupting said mask; and removing said mask from said surface of said wood article.

* * * * *